US010729257B1

(12) United States Patent
Leach

(10) Patent No.: US 10,729,257 B1
(45) Date of Patent: Aug. 4, 2020

(54) INFANT NURSING PILLOW

(71) Applicant: Jamie S. Leach, Ada, OK (US)

(72) Inventor: Jamie S. Leach, Ada, OK (US)

( * ) Notice: Subject to any disclaimer, the term of this patent is extended or adjusted under 35 U.S.C. 154(b) by 363 days.

(21) Appl. No.: 15/173,865

(22) Filed: Jun. 6, 2016

(51) Int. Cl.
*A47D 13/08* (2006.01)

(52) U.S. Cl.
CPC ..... *A47D 13/083* (2013.01)

(58) Field of Classification Search
CPC ..... A47D 13/083
USPC ..... 5/655, 630, 632
See application file for complete search history.

(56) References Cited

U.S. PATENT DOCUMENTS 3,284,817 A 11/1966 Landwirth
4,780,921 A 11/1988 Lahn et al.
4,834,459 A 5/1989 Leach
4,861,109 A 8/1989 Leach
D309,018 S 7/1990 Leach
D315,845 S 4/1991 Lafley
5,103,514 A 4/1992 Leach
5,159,727 A 11/1992 McCracken
5,325,818 A 7/1994 Leach
D384,850 S 10/1997 Fanuzzi
5,700,059 A 12/1997 Moscot
6,343,727 B1 2/2002 Leach
6,427,251 B1 8/2002 Leach
6,499,164 B1 12/2002 Leach
6,502,262 B1 * 1/2003 Piscopo ..... A47C 20/02 5/652
6,502,362 B1 1/2003 Piscopo
6,553,590 B1 4/2003 Leach
6,601,252 B1 8/2003 Leach
6,751,817 B1 6/2004 Leach
6,760,934 B1 7/2004 Leach
6,918,148 B2 * 7/2005 Auxila ..... A47D 13/083 2/16
6,931,683 B1 8/2005 Elkin et al.
7,010,820 B1 3/2006 Veravanich
7,010,821 B1 3/2006 Leach
7,111,347 B1 9/2006 Cottrell
7,114,206 B2 10/2006 Leach
7,197,782 B1 4/2007 Veravanich
7,353,552 B2 4/2008 Leach
7,500,278 B2 3/2009 Leach
7,513,001 B1 4/2009 Leach
D593,787 S 6/2009 Dafna
7,562,406 B1 7/2009 Leach
D606,355 S 12/2009 Zhang
D608,526 S 1/2010 Boesl
(Continued)

*Primary Examiner* — Fredrick C Conley
(74) *Attorney, Agent, or Firm* — Mary M. Lee

(57) ABSTRACT

An infant nursing pillow shaped for use at the side of the caregiver's lap. The pillow is trapezoidal in cross-section having a straight side and an angled side. A padded sleeve is attached on the top of the pillow and is aligned longitudinally. With the pillow positioned alongside her outer thigh and her forearm in the sleeve, the caregiver can cradle the infant in her lap with his head resting on the padded sleeve. The caregiver can adjust the position of the pillow by moving her arm. Alternately, the pillow may be positioned on the caregiver's lap so that the infant's back and head are supported on the pillow. Still further, the pillow may be positioned top down on the caregiver's lap with the bottom supporting the infant or with one side facing down so that the bottom supports the infant at an incline to reduce reflux.

19 Claims, 7 Drawing Sheets

(56) References Cited

U.S. PATENT DOCUMENTS

| | | | | |
|---|---|---|---|---|
| 7,676,871 | B1 | 3/2010 | Leach | |
| 7,708,342 | B2 | 5/2010 | Leach | |
| 7,793,371 | B1 | 9/2010 | Leach | |
| 7,878,587 | B1 | 2/2011 | Leach | |
| 7,926,135 | B1 | 4/2011 | Leach | |
| 8,136,186 | B1 | 3/2012 | Leach | |
| 8,146,760 | B1 | 4/2012 | Leach | |
| 8,419,128 | B1 | 4/2013 | Leach | |
| 8,448,275 | B1 | 5/2013 | Leach | |
| 8,468,627 | B2 | 6/2013 | Leach | |
| 8,479,334 | B1 | 7/2013 | Leach | |
| 8,555,429 | B2 | 10/2013 | Leach | |
| 8,661,587 | B1 | 3/2014 | Leach | |
| 8,661,588 | B1 | 3/2014 | Leach | |
| 8,671,480 | B1 | 3/2014 | Leach | |
| 8,914,927 | B1 | 12/2014 | Leach | |
| 9,003,565 | B1 | 4/2015 | Leach | |
| 9,021,635 | B1 | 5/2015 | Leach | |
| 9,032,572 | B1 | 5/2015 | Leach | |
| 9,101,169 | B1 | 8/2015 | Leach | |
| 9,113,718 | B1 | 8/2015 | Leach | |
| 9,635,956 | B1 | 5/2017 | Leach | |
| 2005/0278864 | A1 | 12/2005 | Leach | |
| 2006/0075563 | A1* | 4/2006 | Bartner | A47D 13/083 5/655 |
| 2007/0022526 | A1 | 2/2007 | Leach | |
| 2007/0028384 | A1 | 2/2007 | Leach | |
| 2007/0046084 | A1 | 3/2007 | Leach | |
| 2007/0151031 | A1 | 7/2007 | Leach | |
| 2007/0277321 | A1 | 12/2007 | Leach | |

* cited by examiner

INFANT NURSING PILLOW

FIELD OF THE INVENTION

The present invention relates generally to pillows and more particularly, but without limitation, to infant nursing pillows.

DETAILED DESCRIPTION OF THE PREFERRED EMBODIMENT(S)

Figure 1:
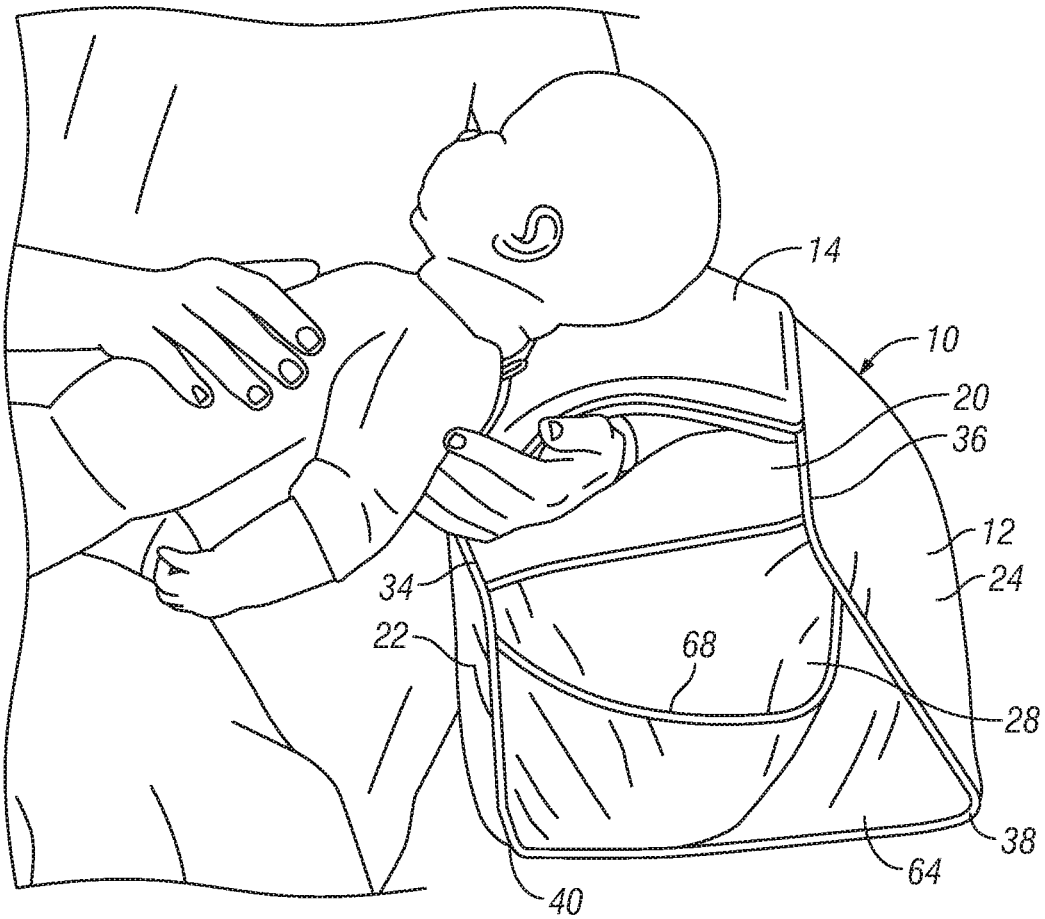
FIG. 1 is a perspective view of an infant nursing pillow made in accordance with a preferred embodiment of the present invention. The pillow is shown positioned adjacent the lap of a caregiver whose arm is received in the sleeve with the infant's head resting on top of the sleeve.
Figure 2:
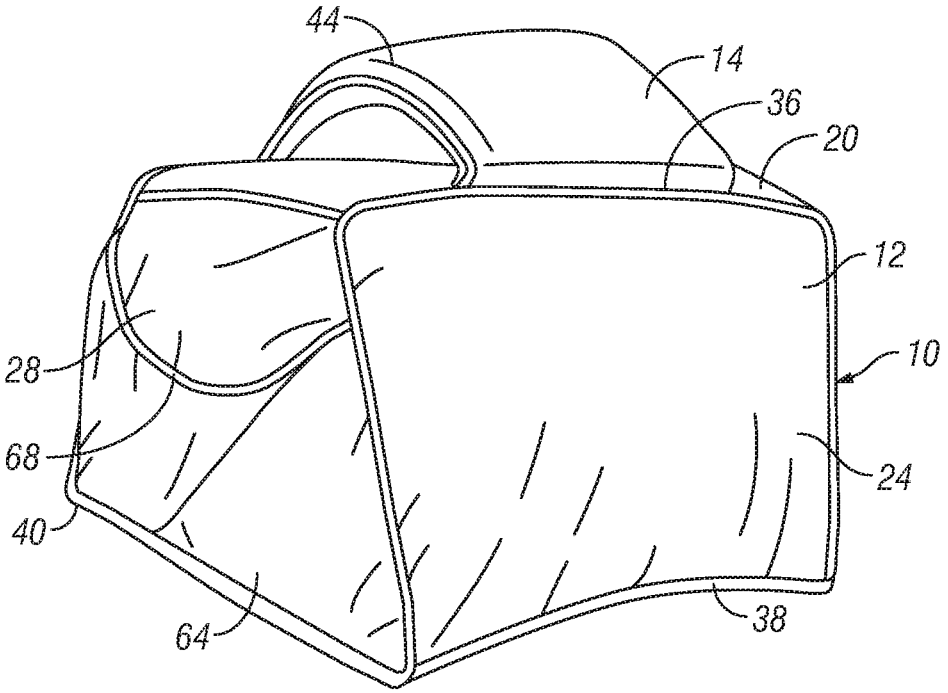
FIG. 2 is a perspective view of the infant nursing pillow shown in FIG. 1.
Figure 3:
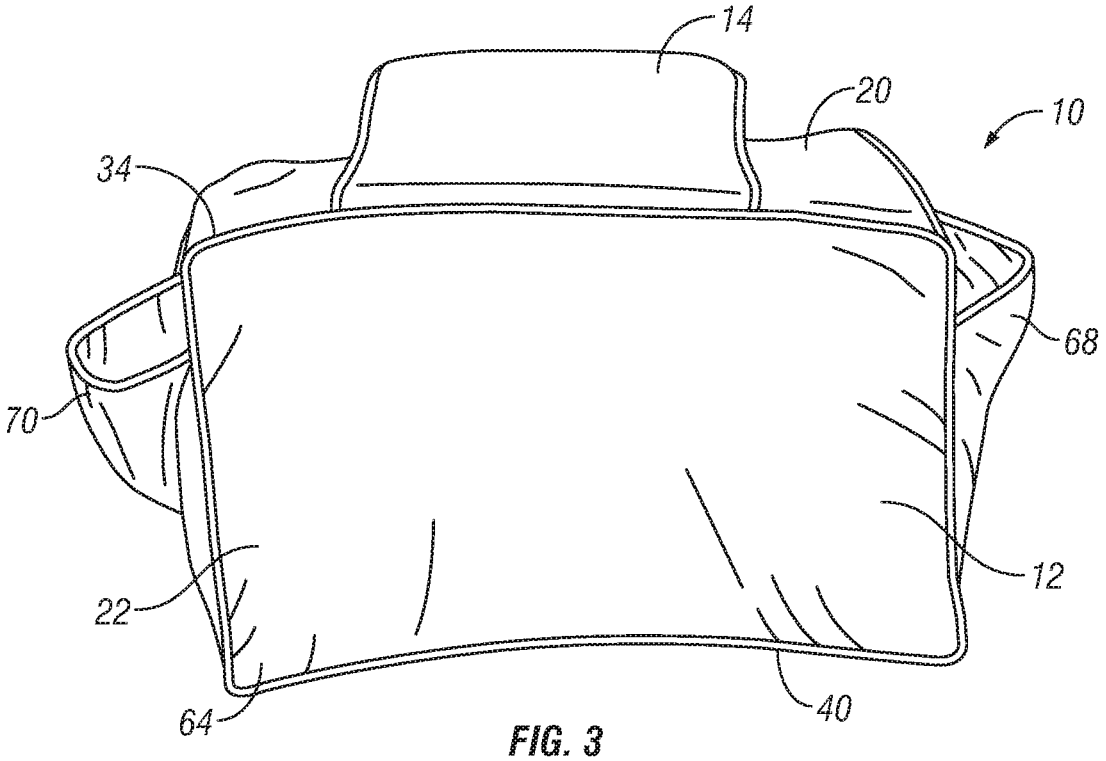
FIG. 3 is an elevational view of a first side of the pillow.
Figure 4:
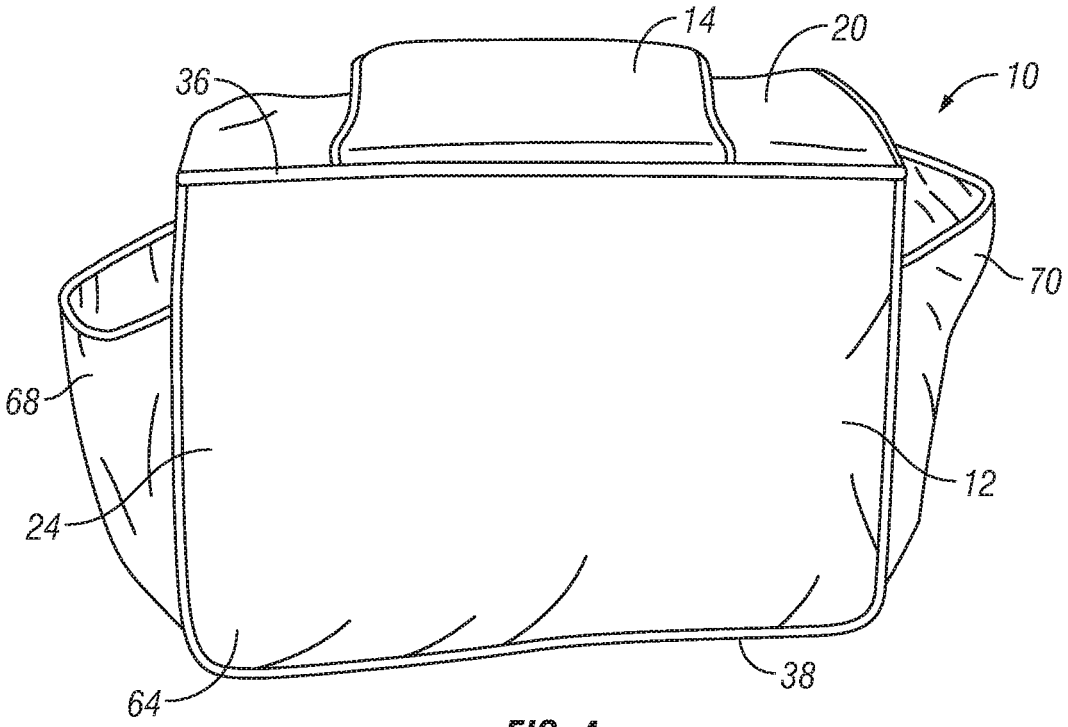
FIG. 4 is an elevational view of a second side of the pillow.

Curved lap pillows are widely available for use by mothers and caregivers to support infants while feeding or nursing. These pillows are designed to be placed on the caregiver's lap with the infant resting across the pillow supporting the infant so that his head is adjacent the breast or chest of the caregiver. This arrangement is uncomfortable for some women and particularly for those women with large breasts. The present invention provides a specially configured pillow that may be positioned at the side of the caregiver's lap instead of on top of it. This allows the infant to lie across the caregiver's lap at a lower level, while the pillow provides cushioned support for the infant's head and the caregiver's arm. These and other advantages will be apparent from the following description of the preferred embodiments.

Turning now to the drawings in general and to FIGS. 1-7 in particular, there is shown therein an infant nursing pillow made in accordance with a preferred embodiment of the present invention and designated generally by the reference numeral 10. The pillow 10 comprises a pillow body 12 and a sleeve 14.

The pillow body 12 preferably is a large, elongate block shape that may be trapezoidal in cross-section as explained more fully hereafter. The body 12 may be formed of compressible shape-sustaining resilient material, such as a solid block of firm polyurethane foam or memory foam in the desired shape. However, in some instances, an inflatable pillow body may be used. Alternately, the body may comprise a fabric enclosure containing a loose filler material, such as but not limited to down feathers and polystyrene pellets.

Referring still to FIGS. 1-7, in the preferred embodiment shown, the pillow body 12 has six faces. The six faces comprise four longitudinal faces that include a bottom 18, a top 20 opposite the bottom, a first side 22, and a second side 24 opposite the first side. The six faces further include first and second end faces 28 and 30. As used herein, the terms "top," "bottom," "side," and "end" are used in a nonrestrictive sense to identify and distinguish the various sides of the pillow body and refer to the pillow in the position shown in FIG. 1, that is, with the widest longitudinal panel 18 on the bottom. As will be described later, the inventive pillow 10 may be used in several different positions, in which the panel 18, referred to herein as the "bottom," is not always oriented in the bottom position.

Figure 5:
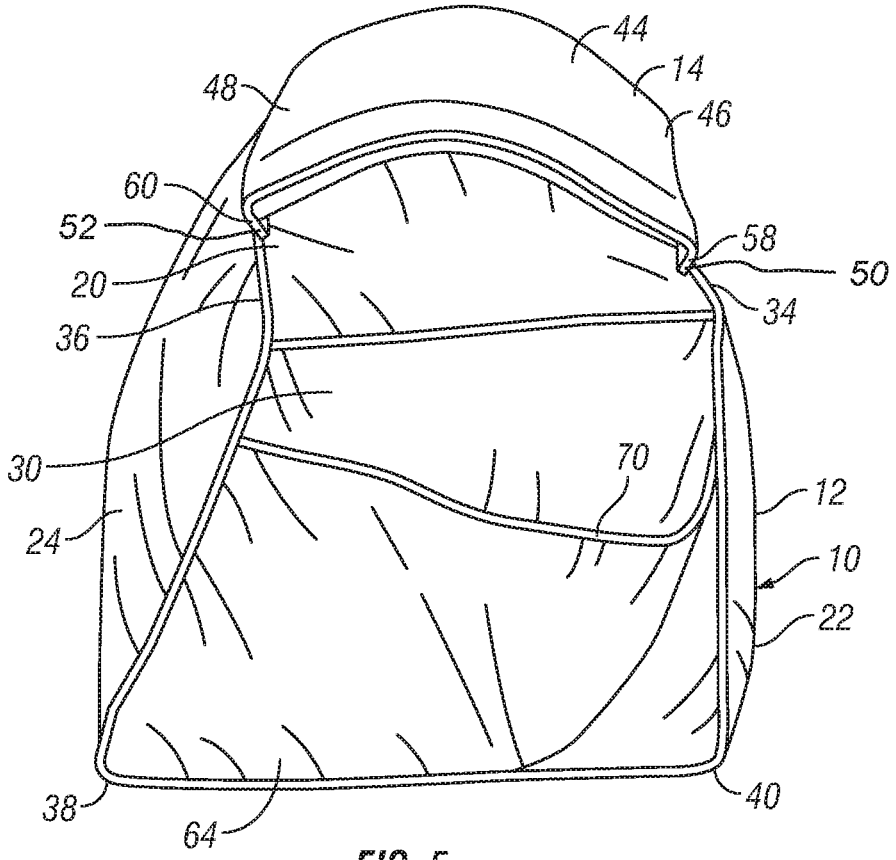
FIG. 5 is an elevational view of a first end of the pillow, the opposite end being a mirror image thereof.

In most cases, the four longitudinal faces 18, 20, 22, and 24 are all generally planar in the resting position, are of equal length, and define parallelograms and, most preferably, each defines a rectangle. However, in the most preferred form, the longitudinal faces have different widths. More specifically, the width of the bottom panel 18 is greater than the width of the top panel 20, as best seen in FIG. 5. This allows the first side panel 22 to be vertical (perpendicular to the plane of the horizon), while the second side 24 is disposed at an angle to the vertical, that is, nonparallel to the first side 22, for a reason explained below. Thus, the plane of the bottom panel 18 and the plane of the first side 22 form a right angle, or a ninety degree (90°) angle, while the plane of the bottom panel and the plane of the second side 24 define an inner angle greater than forty-five degrees (45°) but less than ninety degrees (90°). Referring still to FIG. 5, the four panels 18, 20, 22, and 24, are adjoined at edges 34, 36, 38, and 40.

With continuing reference to FIGS. 1-7, the first and second end faces 28 and 30 also may be planar. Additionally, in the embodiment shown, the end faces 28 and 30 are parallel, though this is not essential.

Figure 6:
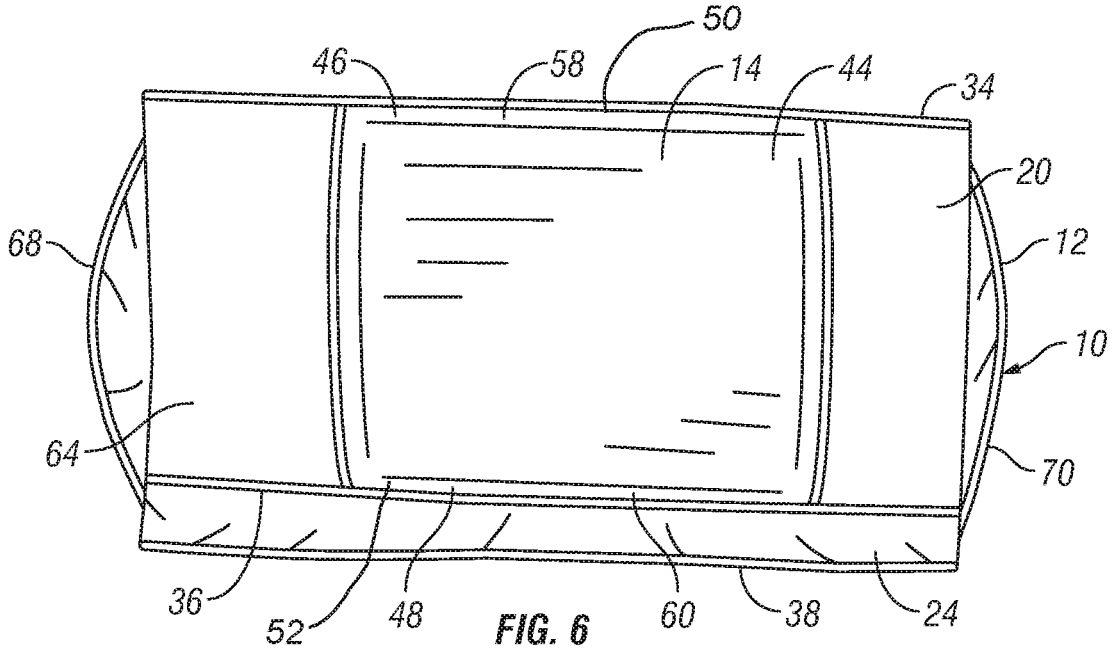
FIG. 6 is a plan view of the pillow.
Figure 7:
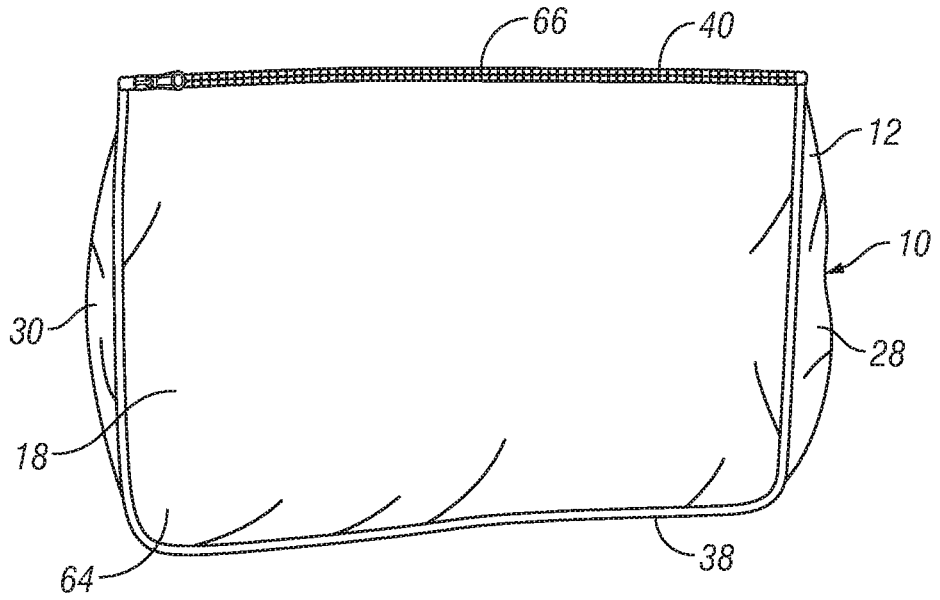
FIG. 7 is a bottom view of the pillow.

Referring still to FIGS. 1-7, the sleeve 14 comprises a padded panel 44 having opposing first and second sides 46 and 48. A first edge 50 is provided on the first side 46 of the panel 44, and a second edge 52 is provided on the second side 48 of the panel, as best seen in FIGS. 5 and 6. Conveniently, the panel 44 is rectangular, though other shapes may be used. The first and second edges 50 and 52 are attached to the top 20 of the pillow body 12 so that the sleeve 14 is aligned longitudinally on the pillow body 12. Ideally, the edges 50 and 52 of the panel 44 are attached along the edges 34 and 36 of the pillow body 12.

Figure 8:
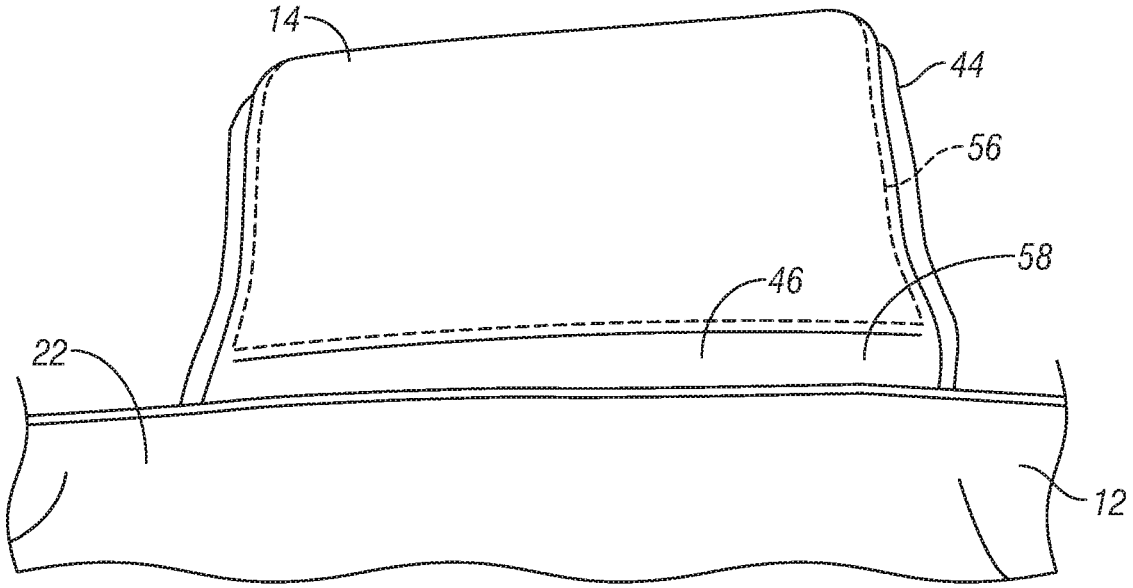
FIG. 8 is an enlarged, fragmented view of the pillow showing the fabric "hinge" along one edge of the sleeve.

Referring now also to FIG. 8, the panel 44 may be simply constructed of two sheets of fabric between which is disposed a sheet or pad of foam 56 to provide a cushion between the baby's head and the caregiver's arm, as seen in FIG. 1. It is desirable to make the foam pad 56 slightly narrower than the width of the panel 44 so that the edges 50 and 52 without foam are more flexible forming hinges 58 and 60 (FIGS. 5&6). This allows the caregiver's arm more freedom of movement within the sleeve 14.

In most instances, it will be advantageous to provide the pillow 10 with a removable cover indicated generally at 64. The cover 64 is shaped to conform to the shape of the pillow body 12, and it may be provided as part of a cover assembly which includes the sleeve 14. That is, the sleeve 14 will be attached to the cover 64. The cover 64 may be made of any suitable fabric, including but not limited to waterproof nylon, flannel, or elastic fabrics, such as spandex or cotton-spandex blends.

A closure, such as a zipper 66 (FIG. 7), is conveniently provided in the cover 64. In the embodiment shown, the zipper 66 is provided along the edge 40, but it may be on one of the other edges 34, 36, or 38, or elsewhere. Other closures may be used, such as hook-and-loop fasteners, snaps, ties, hooks, buttons, and the like. The cover 64 may include at least one pocket for holding items, such as a bottle, keys, pacifiers, a cell phone, and so forth. Preferably, a pocket 68 and 70 is provided on each of the end panels 28 and 30.

Figure 9:
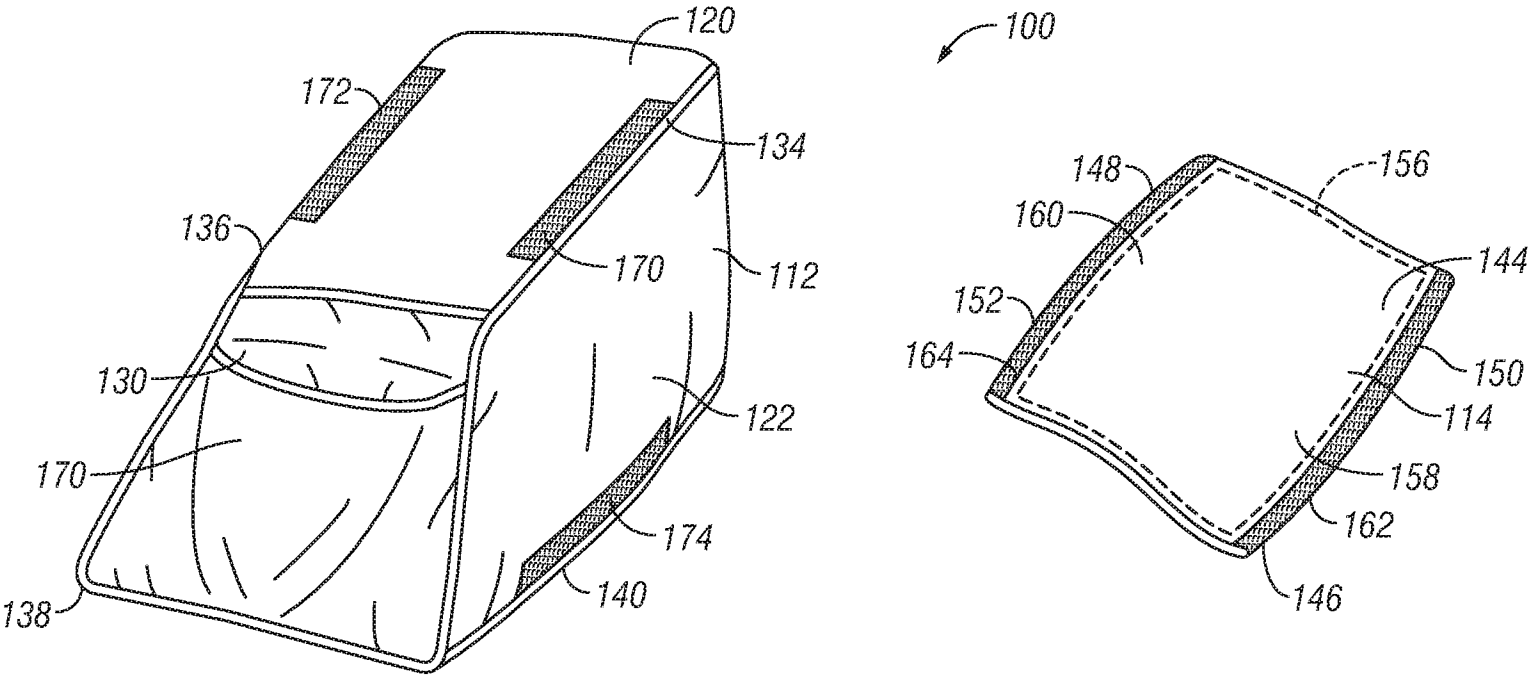
FIG. 9 is an exploded perspective view of a second embodiment of the infant nursing pillow of the present invention in which the sleeve is removably attachable to the pillow in multiple positions.

Turning now to FIG. 9, a second embodiment of the infant nursing pillow will be described. In this embodiment, designated generally at 100, the pillow body 112 is provided with a removably attached sleeve 114. A releasable fastener is employed to attach the sleeve 114. In the embodiment shown, strips of hook-and-loop type fasteners 162 and 164, such as Velcro brand fasteners, are fixed along the edges 150 and 152 of the sides 146 and 148 of the panel 144. Two or more mating hook-and-loop fastener strips, shown at 170, 172, and 174 may be provided along the edges 134, 136, and 140 of the top 120 and the side 122 of the pillow body 112. Additional fasteners may be provided along the edge 138 or on the bottom of the pillow body 112, although not illustrated here. This allows the sleeve 114 to be attached at different positions, depending on the orientation of the pillow body 112.

Having described a preferred construction for the pillow 10, its use now will be explained. FIG. 1 illustrates one position for using the pillow 10 in which the straight side 22 is positioned immediately adjacent the lap of the caregiver. When the infant is reclining across the caregiver's lap, his head rests on the caregiver's arm inside the sleeve 14.

Figure 10:
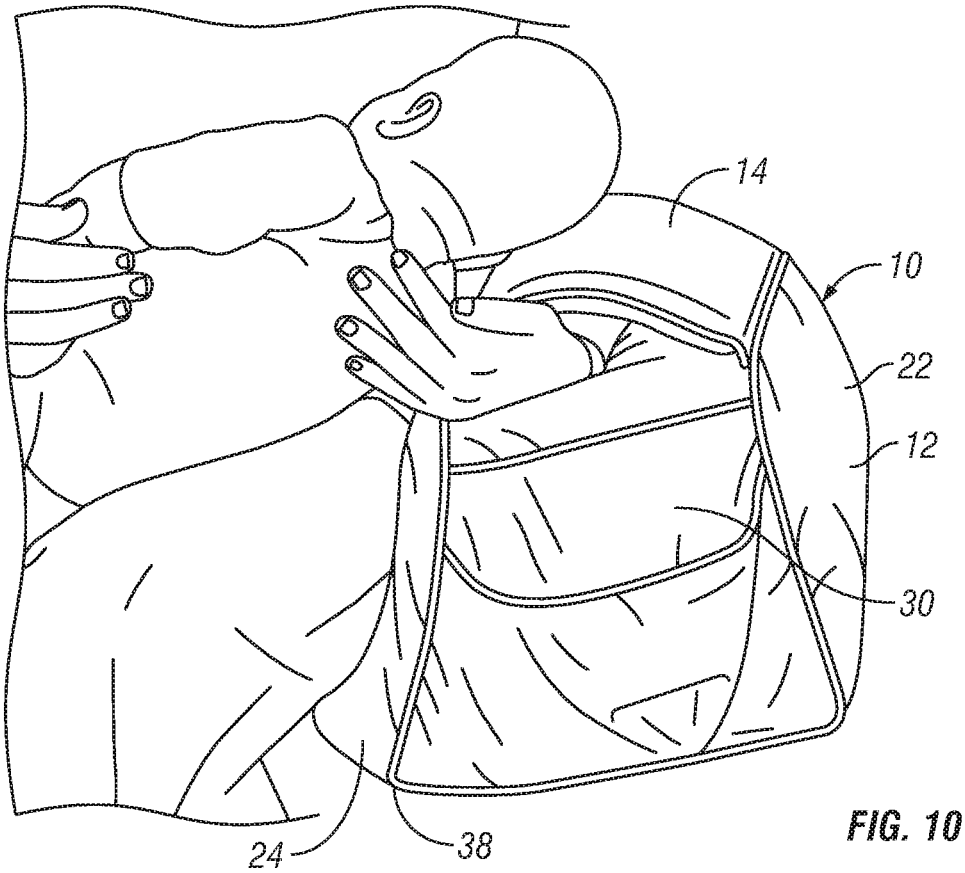
FIG. 10 is a frontal perspective view of the inventive pillow with the angled side adjacent the caregiver's lap.

FIG. 10 shows the pillow 10 positioned so that the slanted or angled side 24 is positioned immediately adjacent the caregiver's lap. The edge 38 can be tucked slightly under the caregiver's thigh. This may be preferred for providing additional stability to the pillow 10.

Figure 11:
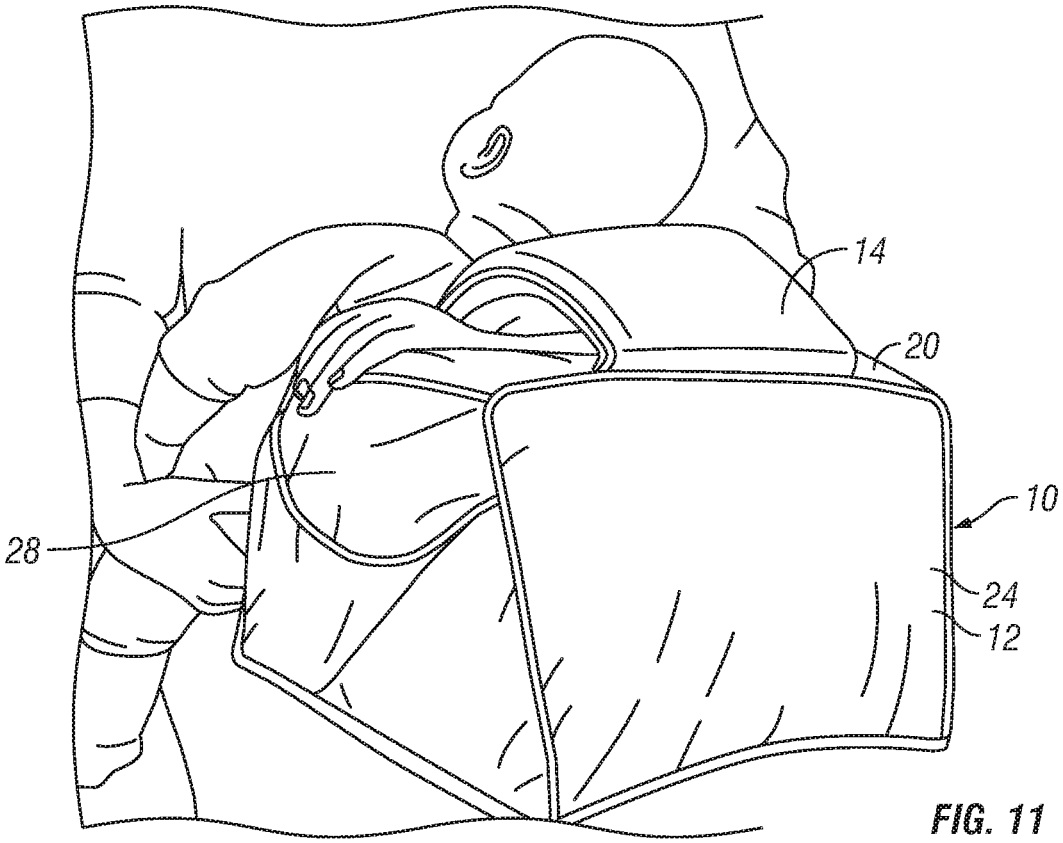
FIG. 11 is a frontal perspective view of the inventive pillow with the bottom on top of the caregiver's lap.

In some cases, the caregiver may wish to place the pillow 10 on her lap, as illustrated in FIG. 11. In this position, the infant may be positioned more upright so that his back is supported by the straight side 22. Although not shown herein, it will be appreciated that the pillow 10 may also be positioned on the lap with the slanted side 24 at the infant's back.

Figure 12:
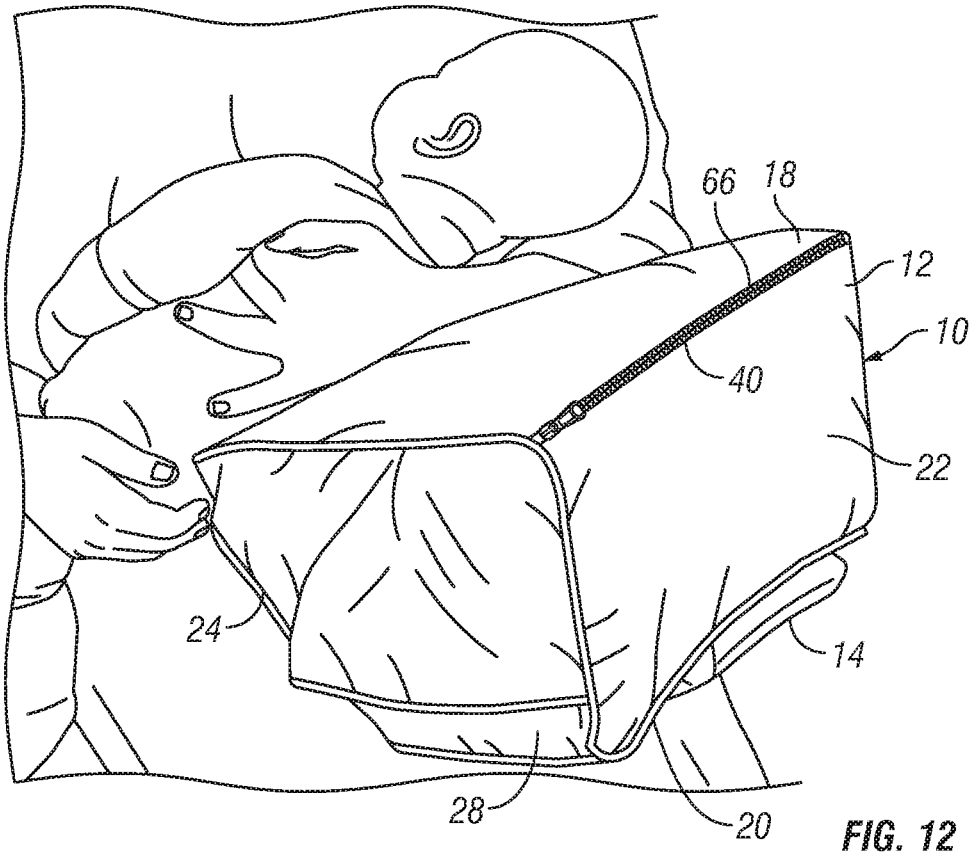
FIG. 12 is a frontal perspective view of the inventive pillow with the top of the pillow positioned downward on the caregiver's lap with the infant resting on the upturned bottom of the pillow.
Figure 13:
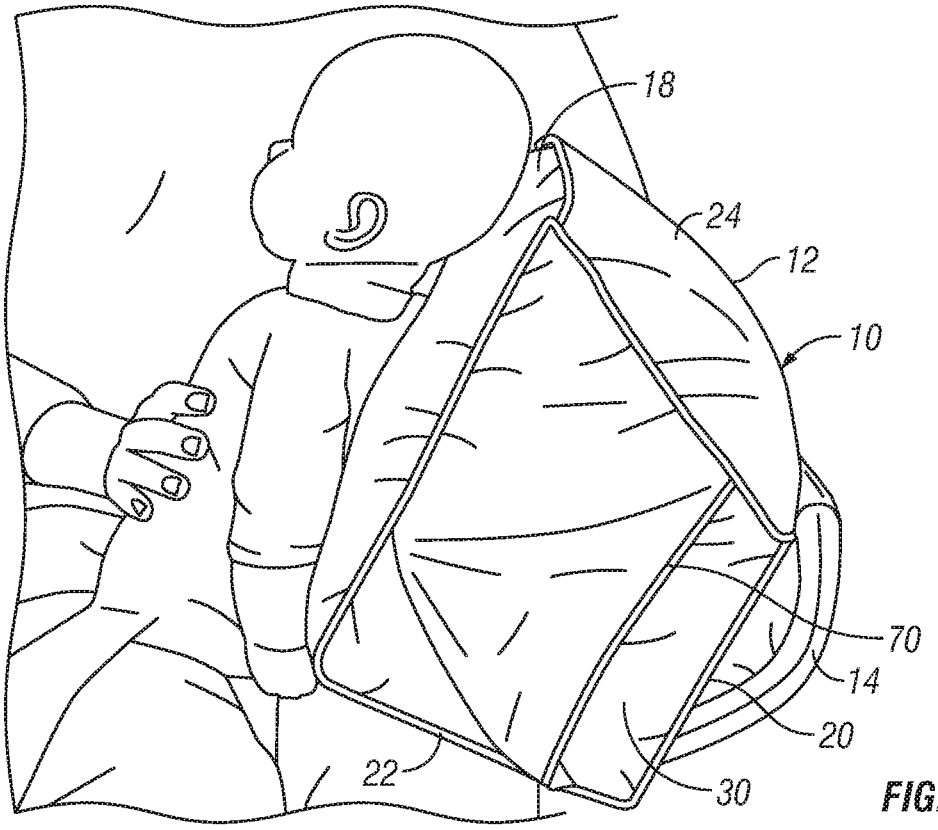
FIG. 13 is a frontal perspective view of the inventive pillow with the straight side of the pillow facing downward on the caregiver's lap and the infant sitting up with his back supported on the upwardly inclined surface of the pillow's bottom.

In some positions, the sleeve 14 is not used. For example, as seen in FIG. 12, the pillow 10 is positioned on the lap with the top 20 facing down and the bottom 18 supporting the caregiver's arm holding the infant. Still further, as depicted in FIG. 13, the pillow 10 may be arranged with the straight side 22 facing down in the caregiver's lap so that the infant is supported in a semi-reclined position against the bottom 18 panel, which in this position is nearly vertical; this position is helpful, especially immediately after nursing, to reduce reflux.

The embodiments shown and described above are exemplary. Many details are often found in the art and, therefore, many such details are neither shown nor described herein. It is not claimed that all of the details, parts, elements, or steps described and shown were invented herein. Even though numerous characteristics and advantages of the present invention have been described in the drawings and accompanying text, the description is illustrative only. Changes may be made in the details, especially in matters of shape, size, and arrangement of the parts within the principles of the invention to the full extent indicated by the broad meaning of the terms of the attached claims. The description and drawings of the specific embodiments herein do not point out what an infringement of this patent would be, but rather provide an example of how to use and make the invention. Likewise, the abstract is neither intended to define the invention, which is measured by the claims, nor is it intended to be limiting as to the scope of the invention in any way. Rather, the limits of the invention and the bounds of the patent protection are measured by and defined in the following claims.

What is claimed is:

1. An infant nursing pillow comprising:

a pillow body formed of compressible, shape sustaining, resilient material and having six faces comprising four longitudinal faces and first and second end faces, wherein the longitudinal faces include a bottom, a top opposite the bottom, a first side, and a second side opposite the first side, and wherein the first side forms a right angle with the bottom, and wherein the second side is nonparallel to the first side; and a sleeve comprising a padded panel having opposing first and second sides, a first edge on the first side of the panel, and second edge on the second side of the panel, and wherein the first and second edges are attached to the top of the pillow body so that the sleeve is aligned longitudinally on the pillow body.

2. The infant nursing pillow of claim 1 wherein the four longitudinal faces are planar.

3. The infant nursing pillow of claim 2 wherein the first and second end faces are planar.

4. The infant nursing pillow of claim 3 wherein the four longitudinal faces are of equal length.

5. The infant nursing pillow of claim 4 wherein each of the four longitudinal faces defines a parallelogram.

6. The infant nursing pillow of claim 5 wherein each of the four longitudinal faces defines a rectangle.

7. The infant nursing pillow of claim 6 wherein each of the top and bottom has a width, wherein the width of the bottom is greater than the width of the top.

8. The infant nursing pillow of claim 7 wherein the bottom and the second side define an inner angle greater than forty-five degrees and less than ninety degrees.

9. The infant nursing pillow of claim 1 wherein each of the four longitudinal faces defines a rectangle.

10. The infant nursing pillow of claim 9 wherein the bottom and the second side define an inner angle greater than forty-five degrees and less than ninety degrees.

11. The infant nursing pillow of claim 1 wherein at least one of the first and second edges of the sleeve is removably attached to the top of the pillow body.

12. The infant nursing pillow of claim 1 wherein each of the first and second edges of the sleeve is unpadded forming a joint.

13. The infant nursing pillow of claim 1 wherein the pillow body comprises at least one pocket.

14. The infant nursing pillow of claim 1 wherein the pillow body comprises a pocket on one or both of the first and second faces.

15. The infant nursing pillow of claim 1 further comprising a removable cover shaped to conform to the shape of the pillow body, wherein the sleeve is attached to the pillow cover.

16. A cover assembly for an infant support pillow, the cover assembly comprising:

a pillow cover shaped to conform to the shape of the infant nursing pillow, wherein the pillow comprises a pillow body formed of shape sustaining resilient material, wherein the pillow body has six faces comprising four longitudinal faces and first and second end faces, wherein the longitudinal faces include a bottom, a top opposite the bottom, a first side, and a second side opposite the first side, wherein the first side forms a right angle with the bottom, and wherein the second side is nonparallel to the first side; and a sleeve comprising a padded panel having opposing first and second sides, a first edge on the first side of the panel, and second edge on the second side of the panel, and wherein the first and second edges are attached to the pillow cover on the top of the pillow body so that the sleeve is aligned longitudinally on the pillow body.

17. The cover assembly of claim 16 wherein each of the four longitudinal faces of the pillow body is planar, wherein each of the four longitudinal faces defines a rectangle.

18. The cover assembly of claim 17 wherein the bottom and the second side of the pillow body define an inner angle greater than forty-five degrees and less than ninety degrees.

19. The cover assembly of claim 18 wherein at least one of the first and second edges of the sleeve is removably attached to the pillow cover on the top of the pillow body.

* * * * *